United States Patent [19]

Möhle et al.

[11] Patent Number: 4,771,210

[45] Date of Patent: Sep. 13, 1988

[54] SPARK PLUG WITH ELECTRODES HAVING NOBLE METAL INSERTS

[75] Inventors: Karl Möhle, Murr; Herbert Lang, Benningen, both of Fed. Rep. of Germany

[73] Assignee: BERU Ruprecht GmbH & Co. KG, Ludwigsburg, Fed. Rep. of Germany

[21] Appl. No.: 16,101

[22] Filed: Feb. 18, 1987

[30] Foreign Application Priority Data

Feb. 19, 1986 [DE] Fed. Rep. of Germany ..... 3605300

[51] Int. Cl.[4] ..... H01T 13/02; H01T 13/20; H01T 13/32; H01T 21/02

[52] U.S. Cl. ..... 313/141; 313/142; 313/136; 445/7

[58] Field of Search ..... 313/136, 141; 445/7

[56] References Cited

U.S. PATENT DOCUMENTS 4,488,081 12/1984 Kondo et al. ..... 313/141
4,540,910 9/1985 Kondo et al. ..... 313/141 X

FOREIGN PATENT DOCUMENTS 2224270 11/1973 Fed. Rep. of Germany .
2421585 1/1975 Fed. Rep. of Germany .
819156 10/1937 France .
448913 6/1936 United Kingdom .

*Primary Examiner*—David K. Moore
*Assistant Examiner*—K. Wieder
*Attorney, Agent, or Firm*—Sixbey, Friedman, Leedom & Ferguson

[57] ABSTRACT

In a spark plug with center electrode and body electrode in which the cylindrical center electrode comprises in its end face a blind bore in which a pin-shaped small-volume noble metal insert is inserted and fixed by upsetting, it is provided that the front region (1*a*) of the center electrode (1), provided with end-side bore (2) and insert (3) disposed therein, is reduced radially over almost the entire length of the bore (2), the reduced region (1*a*) having a constant diameter, and that a further pin-shaped small-volume noble metal insert (5) is fixed in a bore (4) formed coaxially with the bore (2) in the body electrode (6). The production of the spark plug can proceed from commercially usual spark plug parts made on conventional production machines; the noble metal insert of the spark plug is securely attached in the center electrode and the body electrode part opposite the noble metal insert has a reduced burnup, thus increasing the life of the spark plug.

6 Claims, 1 Drawing Sheet

SPARK PLUG WITH ELECTRODES HAVING NOBLE METAL INSERTS

BACKGROUND OF THE INVENTION

The invention relates to a spark plug with centre and body electrode in which the cylindrical centre electrode comprises in its end face a blind bore in which a pin-shaped smallvolume noble metal insert is inserted and fixed by upsetting.

Such a spark plug is described in GE-PS No. 2,421,585. The fixing of the noble metal insert is effected by starting from a middle electrode whose end portion is conically widened at its outer periphery towards the end side; after insertion of the insert into the cylindrical blind bore the conically widened outer periphery of the end portion is upset onto the periphery of the cylindrical centre electrode.

It is not possible here to proceed from commercially usual centre electrodes because the latter do not have a conically widened end portion. In addition, the spark plug described has a conventional ground electrode.

SUMMARY OF THE INVENTION

The problem underlying the invention is to provide a spark plug having body and centre electrodes with noble metal inserts which can be made from conventional commercially available spark plug parts on standard production machines and in which the noble metal insert is reliably secured in the centre electrode, the body electrode portion opposite the noble metal insert of the centre electrode having reduced burnup and the spark plug thus having a longer life.

The problem underlying the invention is solved by the spark plug of the present invention by inserting a pinshaped noble insert into a blind bore in the centre electrode and fixing it there by reducing the diameter of the centre electrode over most, but not all, of the length of the pin-shaped insert. Furthermore, a second pin-shaped noble metal insert is introduced and fixed within a bore extending through the body electrode.

The invention will be explained in detail with the aid of the following Figures.

DETAILED DESCRIPTION OF THE PREFERRED EMBODIMENTS

Figure 1:
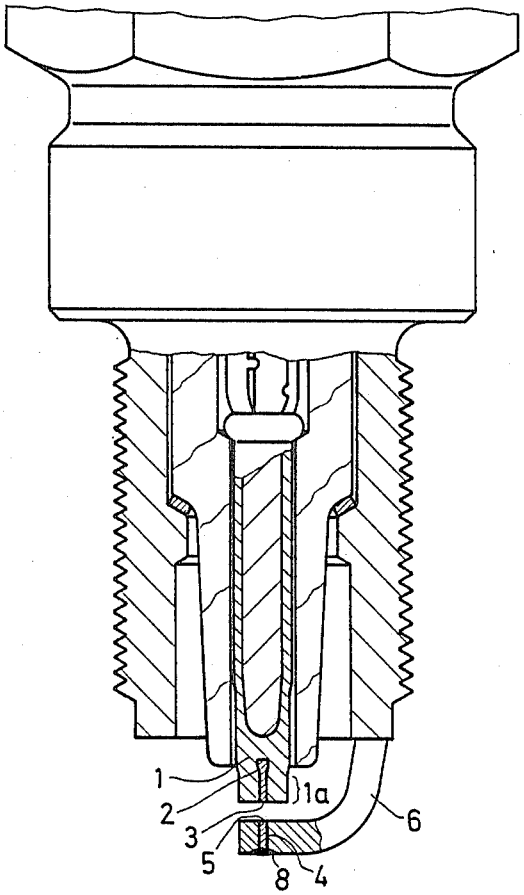
FIG. 1 shows, in cross-section, a preferred embodiment of the spark plug according to the invention.

The spark plug according to FIG. 1, with centre electrode 1 and body electrode 6, differs from commercially available spark plugs of this type in that the front region 1*a* of the centre electrode 1 is uniformly reduced, the reduced region 1*a* being made substantially cylindrical and having a diameter which is somewhat less than that of the usual centre electrode 1. The coaxial bore 2 extends somewhat deeper into the centre electrode 1, the diameter of the bore in this region being somewhat greater than in the reduced region 1*a* of the centre electrode. Opposite the end side of the insert 3 in the bore 2 of the centre electrode 1, a noble metal insert 5 is disposed in a bore 4 coaxial with the bore 2.

The insert 5 is laser or argon welded in the bore 4 at the side 8 of the body electrode 6 remote from the centre electrode 1.

The end face of the commercially usual centre electrode 1 is provided concentrically with a cylindrical bore 2 (FIG. 2*a*), the bore depth preferably being 2 mm and the diameter thereof preferably 0.45 mm. In accordance with FIG. 2*b*, into said bore a correspondingly dimensioned noble metal pin 3 is introduced.

Figure 2:
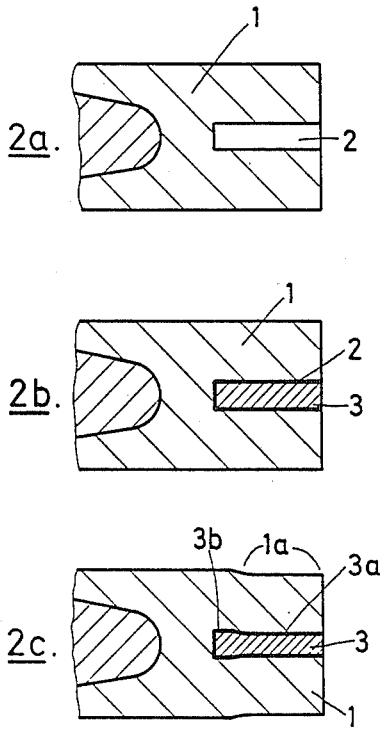
FIGS. 2*a, b* and *c* show, schematically, the fixing of the noble metal insert in the centre electrode tip.

According to FIG. 2*c*, the region 1*a* of the tip of the centre electrode 1 is now reduced over almost the entire length of the bore 2 so that said region 1*a* has a uniform but lesser diameter than the centre electrode body 1.

In the reducing of the region 1a of the centre electrode 1 known in particular in glow plugs, the insert 3 is deformed in the region 3*a* to a smaller diameter while the region 3*b* retains the original diameter because it projects into the remaining region of the bore 2 in the centre electrode 1 which is not reduced like the region 1*a*.

Figure 3:
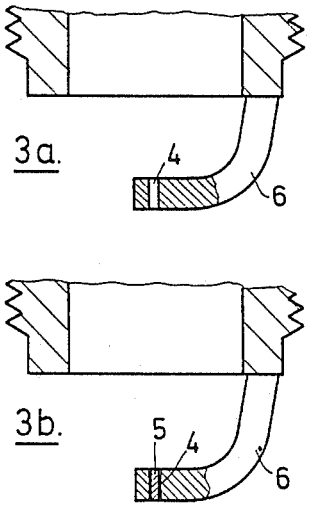
FIGS. 3*a* and *b* show in cross-section the arrangement of the noble metal insert in the body electrode.
Figure 4:
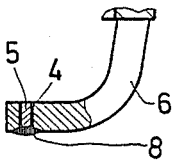
FIGS. 4, 5 and 6 show various ways of securing the noble metal insert in the body electrode.

According to FIGS. 3*a* and 3*b*, the body electrode 6 is provided centrally and coaxially with the bore 2 in the centre electrode with a bore 4. In said bore 4, the small-volume pin-shaped noble metal piece 5 is disposed which, according to FIG. 4, on the rear side 8 is welded to the body electrode 6 by means of high energy density, preferably laser or argon arc welding.

Figure 5:
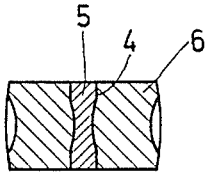
Figure 6:
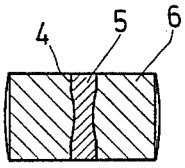

According to FIG. 5, the pin-shaped insert 5 is preferably calked in the body electrode 6; this is done by acting on both sides with two bulged dies in the plane perpendicular to the extent of the bore 4. By using an insert 5 with a somewhat smaller diameter than the bore 4 the space required for the material flow of the insert 5 on deformation is obtained within the bore. According to FIG. 6, the fixing can, however, also be effected by acting on both sides with plane press dies in a manner otherwise analogous to FIG. 5.

The inserts 3 and 5 consist of usual materials and noble metals resistant to burning (consumption). They are preferably platinum or a platinum alloy. The depth of the bore for receiving the insert in the centre electrode is chosen such that between the noble metal insert and the usual copper core a bottom remains which, firstly, permits good heat dissipation and, secondly, prevents melting out of the copper core on unintentional detachment of the noble metal insert.

We claim:

1. Spark plug with centre and body electrodes, wherein the centre electrode is cylindrical and comprises an end face having a blind bore in which a first pin-shaped small-volume noble metal insert is inserted and fixed; wherein the centre electrode, said bore and said insert are radially reduced from a constant diameter in a front region thereof that extends over almost the entire length of the bore from said end face while leaving an unreduced inner end serving as a means for anchoring said insert in said bore, said reduced region having a constant diameter, and wherein a second pin-shaped small-volume noble metal insert is fixed in a bore which is formed through said body electrode coaxially with respect to said blind bore in the body electrode.

2. Spark plug with centre and body electrodes according to claim 1, said second pin-shaped noble metal insert is undetachably disposed in the bore of the body electrode by welding of high energy density on a side thereof that is remote from the end face of the centre electrode.

3. Spark plug with centre and body electrodes according to claim 2, said second pin-shaped noble metal insert is undetachably fixed in the bore of the body electrode by laser or argon arc welding.

4. Spark plug according to claim 2, the second pin-shaped noble metal insert is fixed in the bore of the body electrode by radial calking of the body electrode with respect to the bore in the body electrode in a region of the bore intermediate opposite ends of the second inner noble metal insert.

5. Method of making a spark plug with a centre electrode and a body electrode which each contain noble metal regions comprising the steps of forming a constant diameter blind bore in an end face of the centre electrode of constant diameter; introducing a first pin-shaped noble metal insert with the same or somewhat smaller diameter as the diameter of the blind bore into said blind bore; reducing a front region of the centre electrode to a cylindrical region whose wall length is somewhat smaller than the depth of the bore in a manner resulting in the first pin-shaped noble metal insert being deformed to a thinner region while leaving an inner region of initial thickness for retaining the first insert within said blind bore forming a bore through the body electrode coaxially with the bore in the centre electrode; introducing into the bore of the body electrode, a second pinshaped noble metal insert of the same length as the thickness of the body electrode being equal to or somewhat less than the diameter of the bore; and fixing the second pin-shaped noble metal insert with the bore of the body electrode by at least one of welding of high energy density and calking.

6. Spark plug according to claim 1, the pin-shaped noble metal insert is fixed in the bore of the body electrode by radial calking of the body electrode with respect to the bore in the body electrode in a region of the intermediate opposite ends of the second inner noble metal insert.

* * * * *